US009797633B2

(12) United States Patent
Beach

(10) Patent No.: US 9,797,633 B2
(45) Date of Patent: Oct. 24, 2017

(54) TEMPERATURE REGULATING FOOD CONVEYING CONTAINER SYSTEM

(71) Applicant: Pearl Beach, Tulsa, OK (US)

(72) Inventor: Pearl Beach, Tulsa, OK (US)

( * ) Notice: Subject to any disclaimer, the term of this patent is extended or adjusted under 35 U.S.C. 154(b) by 397 days.

(21) Appl. No.: 14/557,713

(22) Filed: Dec. 2, 2014

(65) Prior Publication Data

US 2015/0159926 A1 Jun. 11, 2015

Related U.S. Application Data

(60) Provisional application No. 61/912,921, filed on Dec. 6, 2013.

(51) Int. Cl.

| | |
|---|---|
| ***F25B 21/02*** | (2006.01) |
| ***F25B 21/04*** | (2006.01) |
| ***F25B 21/00*** | (2006.01) |
| *A47B 63/00* | (2006.01) |
| *A47B 49/00* | (2006.01) |

(52) U.S. Cl.

CPC ..... *F25B 21/04* (2013.01); *F25B 21/00* (2013.01); *F25B 21/02* (2013.01); *A47B 49/004* (2013.01); *A47B 2063/005* (2013.01); *F25B 2321/021* (2013.01)

(58) Field of Classification Search

CPC ..... F25B 21/02; F25B 21/00; F25B 21/04; F25B 2321/021; A47B 49/004; A47B 2063/005

See application file for complete search history.

(56) References Cited

U.S. PATENT DOCUMENTS

| | | | | |
|---|---|---|---|---|
| 2,327,631 A | | 8/1943 | Fibus | |
| 2,644,567 A | | 7/1953 | Springer | |
| 2,677,940 A | | 5/1954 | Raskin | |
| 2,986,019 A | | 5/1961 | Armour | |
| 3,115,019 A | | 12/1963 | Rutishauser | |
| 3,308,633 A | | 3/1967 | Kritzer | |
| 3,481,154 A | | 12/1969 | Johnson | |
| 3,636,299 A | | 1/1972 | Stewart, Jr. | |
| 3,769,805 A | * | 11/1973 | Corini | A47F 3/0404 62/250 |
| 3,874,479 A | | 4/1975 | Onori et al. | |
| 3,887,786 A | | 6/1975 | Witt et al. | |
| 4,007,810 A | | 2/1977 | Weddendorf | |
| 4,165,620 A | | 8/1979 | Kiesel et al. | |

(Continued)

FOREIGN PATENT DOCUMENTS

| | | | | |
|---|---|---|---|---|
| NZ | WO 97/33803 | * | 9/1997 | B65D 43/16 |

*Primary Examiner* — David Teitelbaum

(74) *Attorney, Agent, or Firm* — PatentFile, LLC; Bradley C. Fach; Steven R. Kick

(57) ABSTRACT

A novel temperature regulating food conveying container system for holding hot and cold food in close proximity is provided. In preferred embodiments, the system generally includes a plurality of stacked, concentric, and annular levels with decreasing diameters. The levels are configured with a plurality of food serving containers each with a corresponding temperature regulating unit. One or more motors may be configured to rotate the individual levels. One or more light elements may be positioned at various locations on and around the levels. In further preferred embodiments, a control switch is configured to control the temperature of each individual temperature unit.

18 Claims, 10 Drawing Sheets

(56) References Cited

U.S. PATENT DOCUMENTS

| | | | | |
|---|---|---|---|---|
| 4,216,845 | A | 8/1980 | Tashman et al. | |
| 4,314,458 | A | 2/1982 | Hade et al. | |
| 4,765,440 | A | 8/1988 | Tashman | |
| 4,848,091 | A | 7/1989 | Border | |
| 5,377,492 | A | 1/1995 | Robertson et al. | |
| 5,419,099 | A | 5/1995 | Mueller et al. | |
| 5,477,778 | A | 12/1995 | Kuwahara | |
| 6,497,305 | B2 | 12/2002 | Beach | |
| 6,539,846 | B2 * | 4/2003 | Citterio | A47J 39/006 165/919 |
| 6,681,684 | B1 * | 1/2004 | Chen | A47G 19/02 206/509 |
| 7,005,615 | B2 | 2/2006 | Thomas | |
| 7,775,346 | B1 | 8/2010 | Taylor | |
| 8,701,554 | B2 | 4/2014 | Hartsfield et al. | |
| 2005/0072711 | A1 | 4/2005 | Yang | |
| 2006/0289445 | A1 | 12/2006 | Colonna | |
| 2008/0213449 | A1 * | 9/2008 | Wisner | A47J 39/006 426/520 |
| 2012/0248088 | A1 | 10/2012 | McMahon et al. | |

* cited by examiner

TEMPERATURE REGULATING FOOD CONVEYING CONTAINER SYSTEM

CROSS REFERENCE TO RELATED APPLICATIONS

This application claims priority to and the benefit of the filing date of U.S. Provisional Application No. 61/912,921, filed on Dec. 6, 2013, entitled "TEMPERATURE REGULATING FOOD CONVEYING CONTAINER SYSTEM", which is hereby incorporated by reference in its entirety.

FIELD OF THE INVENTION

The present invention relates to food conveyors and more particularly pertains to a new temperature regulating food service conveying container system for providing a space saving device for simultaneously holding hot and cold food.

BACKGROUND

The use of food service containers is known in the prior art. These containers may be primarily configured to dispense food while maintaining the food at desired temperatures. These containers are primarily utilized in institutional and commercial settings and are configured with a plurality of containers that keep cold foods cold and hot foods hot. While they excel at storing and dispensing food at desired temperatures, a food service worker is typically employed to dispense the food because the containers and manner of dispensing inevitably results in an aesthetically unpleasing food presentation. These containers also prohibit storing foods with a higher temperature in close proximity to foods with a lower temperature.

Other food service containers are primarily configured to display food in an aesthetically pleasing manner. These containers may be utilize lights and motorized sections in order to present the food in an artful and appetizing display, however they are unable to maintain the desired serving temperature of the food. This results in the need for food service workers to closely monitor the temperature of the food and ultimately in a shortened duration for food display. These containers also prohibit storing foods with a higher temperature in close proximity to foods with a lower temperature.

Recently, food service containers have become available that are capable of storing and dispensing food at desired temperatures while doing so in an aesthetically pleasing manner. These containers may be configured to display foods while requiring foods with like serving temperatures to be sequestered from foods with different serving temperatures. This frequently results in the need for multiple food service containers and limits the food positioning and displaying options.

Therefore a need exists for a food conveying container that is able to maintain and dispense food at desired temperatures. A further need exists for a food conveying container system that is able to maintain a plurality of different temperature food items in close proximity to one another. Finally, there is a need for a novel food container that is able to convey and display temperature regulated food in an aesthetically pleasing manner.

BRIEF SUMMARY OF THE INVENTION

The present invention comprises a novel temperature regulating food conveying container system for holding hot and cold food in close proximity. The system generally includes a plurality of stacked, concentric, and annular levels with decreasing diameters. The levels are configured with a plurality of food containers each with a corresponding temperature regulating unit. The levels may be configured with one or more motors configured to rotate the individual levels. One or more light elements may be positioned at various locations on and around the levels. In preferred embodiments, a control unit is configured to control the temperature of each individual temperature unit, the rotation and speed of each motor, and the color and brightness of each light element. The control unit may be operated by a user input while the desired control settings are stored in a memory. A display is preferably attached to the control unit and is configured to assist and confirm control settings.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

New sealing temperature regulating food conveying container systems are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

Figure 1:
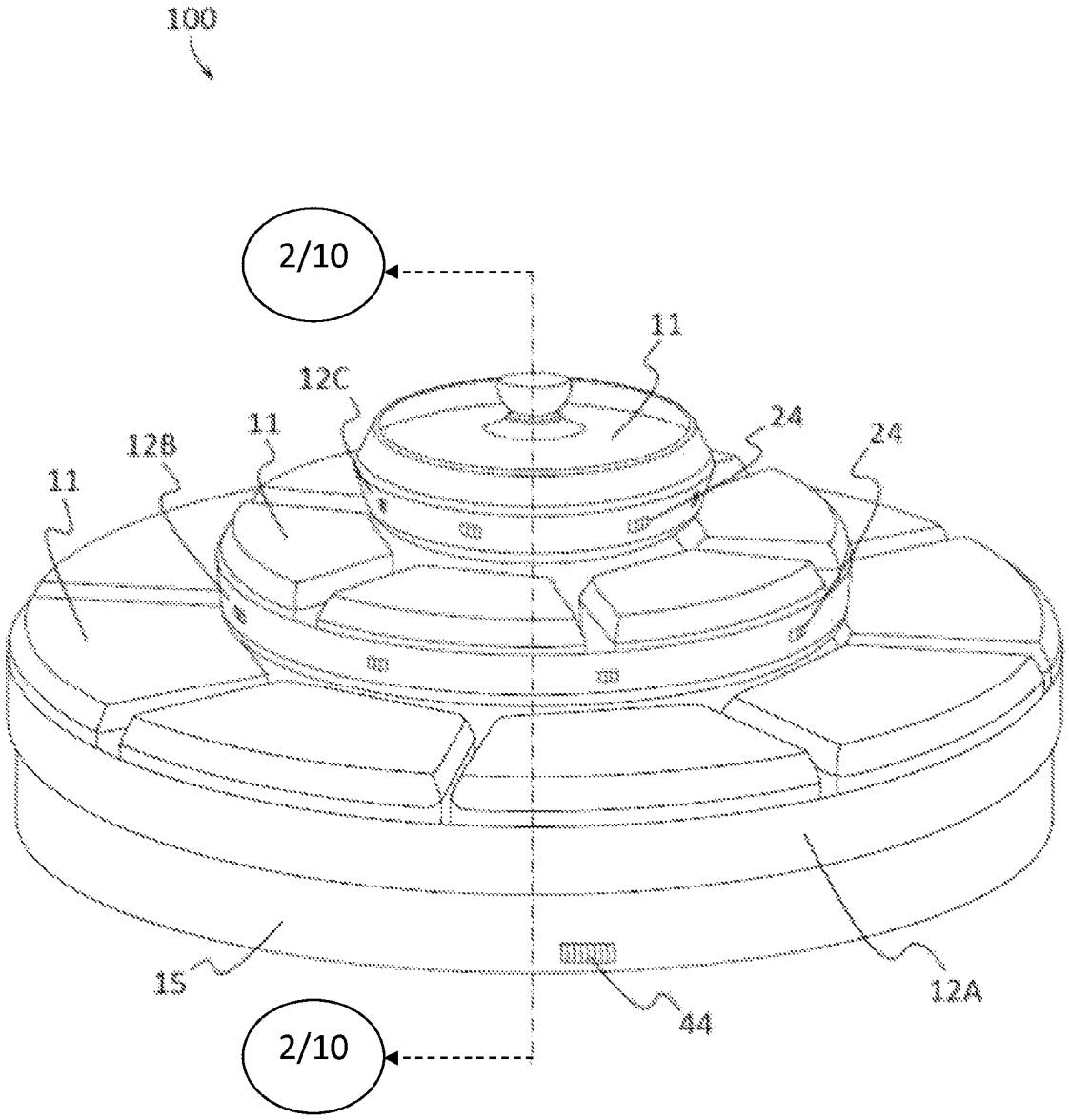
FIG. 1 depicts a top perspective view of one example of a temperature regulating food conveying container system according to various embodiments of the present invention.

The present invention will now be described by referencing the appended figures representing preferred embodiments. FIG. 1 depicts a top perspective view of an example of a temperature regulating food conveying container system 100 (the "system") for transporting a plurality of food serving containers according to various embodiments. In this example, the system 100 comprises a plurality of food serving containers 11 positioned on a lower level 12A, a second level 12B, and an upper level 12C each of which may be of an annular shape. The system 100 may comprise one or more levels 12, but preferably a plurality of levels 12 such as two levels 12, three levels 12, four levels 12, or more levels 12 with each level preferably in a different plane or level than another level 12. A base 15 may be positioned under the lower level 12A and may be configured to support the system 100 or allow it to rest on a surface. In some embodiments, two or more second levels 12B may be positioned in between the lower level 12A and the upper level 12C. In further embodiments, the system 100 may not comprise a second level 12B. In some embodiments, one or more vents 44 may be positioned around the levels 12 or base 15 to prevent heat buildup within the system 100. In some embodiments, upper or top most level 12C may be removable from the entire system 100.

In further preferred embodiments, a temperature regulating food conveying container system 100 may comprise a base 15 for resting on a surface; one or more rotatable levels mounted to the base 15 in a tiered orientation, with the plurality of rotatable levels 12 housing a plurality of food serving containers 11. The plurality of food serving containers 11 may comprise container side walls 19 adapted to retain food within a container cavity 21 and a container bottom 22 said container bottom 22 having a thermally conductive bottom surface 23. One or more discrete temperature modifying units (temp units) 40 may be mounted on a rotatable level 12 wherein each discrete a temperature modifying unit 40 has a temperature regulating surface 41 in thermal connection with a container bottom 22, and a control switch 24 in electrical communication with a temperature modifying unit 40. The control switch 24 may be configured to change the temperature regulating surface 41 of each temperature modifying unit 40 between a first temperature type and a second temperature type.

In further preferred embodiments, the plurality of rotatable levels 12 comprises a first rotatable level 12A positioned directly above and adjacent to the base 15. A level 12 may comprise an upper surface 13 housing a plurality of temperature modifying units 40 with each temperature modifying unit 40 configured to make thermal contact with the container bottom 22 of a food serving container 11 in a one-to-one configuration whereby a single temperature modifying unit 40 is in thermal contact with only one food serving container 11. The plurality of rotatable levels 12 may also comprise a second rotatable level 12B positioned directly above and adjacent to the first rotatable level 12A and having an upper surface 13 housing a plurality of temperature modifying units 40 with each temperature modifying unit 40 configured to make thermal contact with the container bottom 22 of a food serving container 11 in a one-to-one configuration whereby a single temperature modifying unit 40 is thermal contact with only one food serving container. The plurality of rotatable levels 12 may also comprise a third level 12C positioned directly above and adjacent to the second rotatable level 12B and having an upper surface 13 housing a temperature modifying unit 40 with the temperature modifying unit 40 configured to make thermal contact with the container bottom 22 of a food serving container 11. Preferably, the third level 12C may also be configured to rotate. In still further embodiments, all of the levels may be configured with a one or more depressions configured to collect food drippings and condensation.

One or more control switches 24 may be positioned on the system 100 and preferably in proximity to a food serving container 11. A control switch 24 may be configured to change the temperature regulating surface 41 of a temperature modifying unit 40 between a first temperature type and a second temperature type by supplying electric current or power to a temperature modifying unit 40. A control switch 24 may comprise a control input such as turnable control knobs, depressable button type switches, slide type switches, rocker type switches, or any other suitable input that may be used to modulate the electricity supplied to one or more temperature modifying units 40, motors 20, and/or light elements 30.

In some embodiments, the first temperature type may be hot and a thermoelectric effect may heat the temperature regulating surface 41 of the temperature modifying unit 40, while the second temperature type may be cold and a thermoelectric effect may cool the temperature regulating surface 41 of the temperature modifying unit 40. In some embodiments, a hot temperature type may comprise a range of temperatures between 70 degrees and 300 degrees Fahrenheit, but preferably between 100 degrees and 200 degrees Fahrenheit. In further embodiments, a cold temperature type may comprise a range of temperatures between 20 degrees and 70 degrees Fahrenheit, but preferably between 35 degrees and 50 degrees Fahrenheit. The first temperature type and second temperature type is dependent upon the direction of the electrical current supplied to the temperature modifying unit 40 by the control switch 24 so that a control switch 24 may also be configured to change the direction of current supplied to one or more a temperature modifying units 40, thereby changing the temperature regulating surface 41 between a first temperature type such as hot with a thermoelectric effect that heats a temperature regulating surface 41 of the temperature modifying unit 40 and a second temperature type such as cold with a thermoelectric effect that cools the temperature regulating surface 41 of the temperature modifying unit 40.

Figure 2:
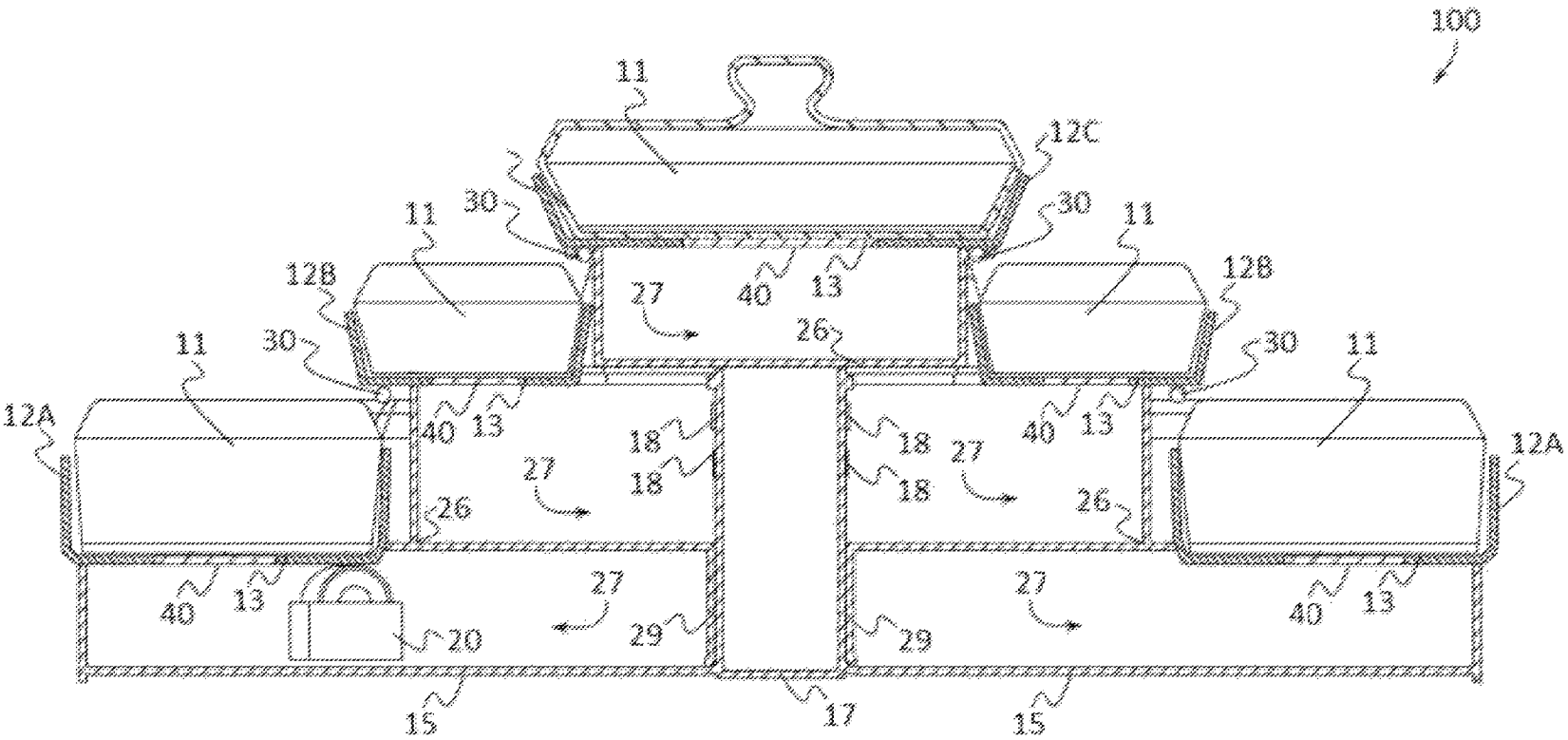
FIG. 2 illustrates a sectional, through line 2-2 shown in FIG. 1, elevation view of a preferred example of a temperature regulating food conveying container system according to various embodiments described herein.

FIG. 2 illustrates a sectional, through line 2-2 shown in FIG. 1, elevation view of an example of a temperature regulating food conveying container system 100 according to various embodiments described herein. In this preferred embodiment, the first or lower level 12A, second or second level 12B, and third or upper level 12C are each coupled to one or more level side walls 26 optionally forming a level chamber 27 below each level 12. A level chamber 27 may form a hollow space allowing one or more electrical components such as temperature modifying units 40, motors 20, control units 53 (FIGS. 7-9) to be received within the system 100 and coupled to a level side wall 26. One or more level side walls 26 may also be rotatably coupled to the central support 17 and/or the base 15 with one or more rotational couplings 29 allowing the lower level 12A, second level 12B, and upper level 12C to rotate in unison around the axis provided by the central support 17 which may be non-rotatably coupled to the base 15. A rotational coupling 29 may comprise a bearing such as a plain bearing, rolling elements bearing, jewel bearing, fluid bearing, magnetic bearing, or any other suitable connection method suitable for coupling a level side wall 26 to a central support 17 while allowing the level side wall 26 to rotate relative to a central support 17.

In this embodiment, one or more motors 20 may be coupled to the base 15 and one or more level side walls 26 and configured the rotate the three levels 12 around a central support 17 which is attached to the base 15 in a substantially perpendicular orientation. The motors 20 may be configured with gears, chains, screw drives, belts, or any other suitable rotational enabling method which may be attached to each level 12 thereby transferring the rotational motion of one or more motors 20 into rotational movement for the lower level 12, second level 13, and upper level 14. In some embodiments, a motor 20 may be coupled to a level side wall 26 and be configured to rotate one or more gears comprising a plurality of teeth. The teeth of the gears may be configured to engage with a component of a level 12 such as a plurality of protrusions on a surface of the level 12, thereby transferring the rotational movement from the motor 20 coupled to the level side wall 26 to rotate the levels 12. In other embodiments, a motor 20 may be coupled to a surface of a level 12 and be configured to rotate one or more gears comprising a plurality of teeth. The teeth of the gears may be configured to engage with a component of a level side wall 26 such as a plurality of protrusions on a surface of the level side wall 26, thereby transferring the rotational movement from the motor 20 coupled to the level 12 to rotate the levels 12. In preferred embodiments, the motors 20 are capable of rotating the levels 12 at a range of speeds while the base 15 remains stationary. In some embodiments, the upper level 12C may not be configured to rotate and may instead be stationary in nature.

A plurality of light elements 30 may be positioned or in proximity to a level 12 such as on a lower level 12A, second level 12B, an upper level 12C. In preferred embodiments, the light elements 30 are able to display various colors and intensities of light and may comprise one or more light emitting diodes (LEDs). In other embodiments, the light elements 30 may comprise one or more other light emitting elements such as incandescent light bulbs, halogen light bulbs, laser light emitters, electroluminescent light sources, neon light sources, or any other suitable light source.

One or more electric temperature modifying units 40, motors 20, and/or light elements 30 on each level 12 may be supplied power through one or more sets of wiping electrical contacts 18 or contact wipes positioned on the central support 17. Each of the rotatable levels 12 may be rotatably mounted to a portion of the central support 17 and may comprise one or more wiping electrical contacts 18 that may contact one or more wiping electrical contacts 18 on the central support 17 thereby providing power to one or more electric temperature modifying units 40, motors 20, and/or light elements 30 on each level 12. The wiping electrical contacts 18 may be made from beryllium copper or other low friction electrically conductive material.

As perhaps best illustrated in FIG. 2, each rotatable level 12 comprises an upper surface 13 configured to support one or more food serving containers 11 and one or more temperature modifying units 40. The upper surface 13 may comprise a temperature regulating surface 41 of a temperature modifying unit 40 that may be configured to contact the thermally conductive bottom surface 23 (FIG. 6) of a food serving container 11. In other embodiments, the upper surface 13 may comprise a thermally conductive material such as aluminum, copper, other metal or metal alloy, thermally conductive ceramics, thermally conductive plastics, thermally conductive, glass, and the like configured to contact the temperature regulating surface 41 of a temperature modifying unit 40 and to contact the thermally conductive bottom surface 23 (FIG. 6) of a food serving container 11. In preferred embodiments, an upper surface 13 may comprise a plurality of temperature regulating surfaces 41, each of which may be configured to contact the thermally conductive bottom surface 23 (FIG. 6) of a food serving container 11, thereby providing thermal contact between a food serving container 11 supported on a level 12 and a temperature modifying unit 40.

Figure 3:
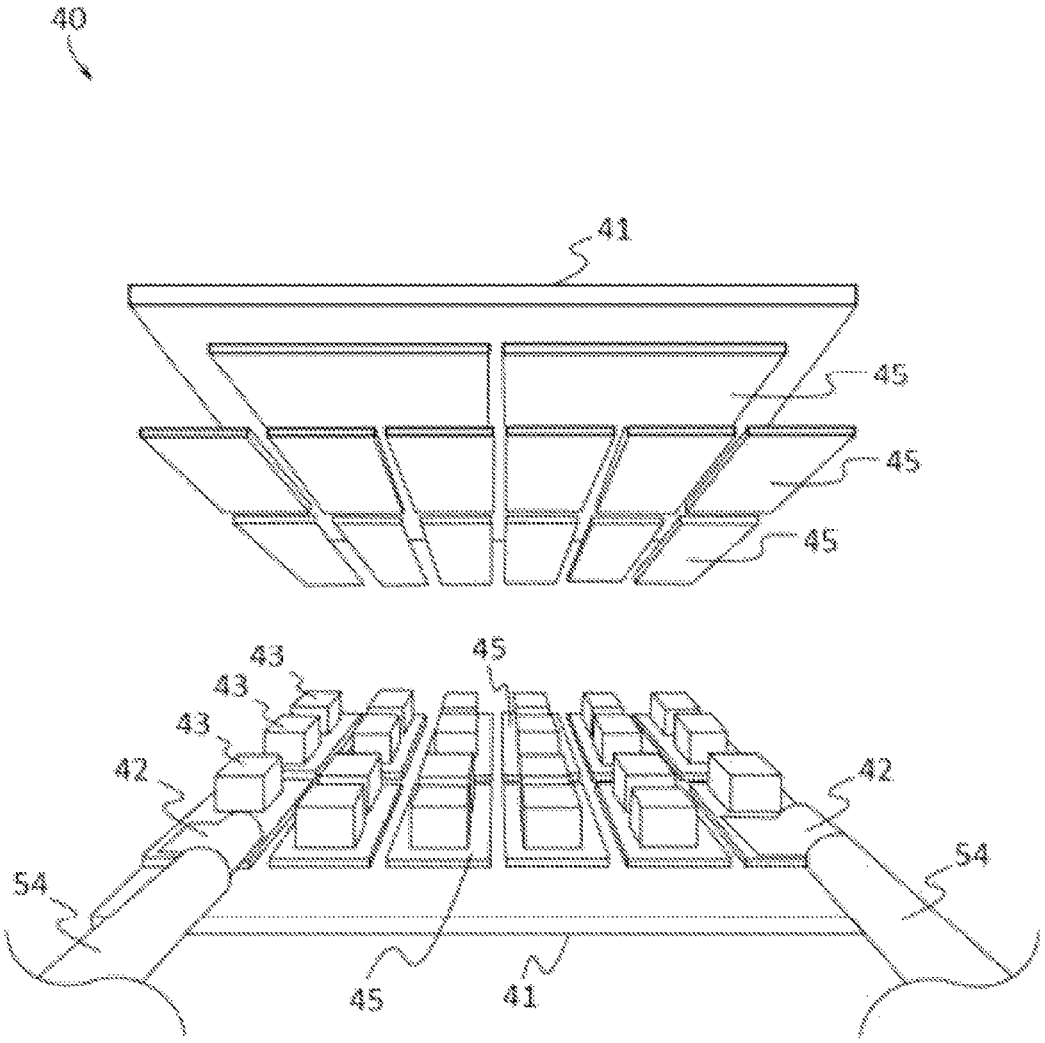
FIG. 3 shows a perspective exploded view of an example of a temperature modifying unit according to various embodiments described herein.
Figure 4A:
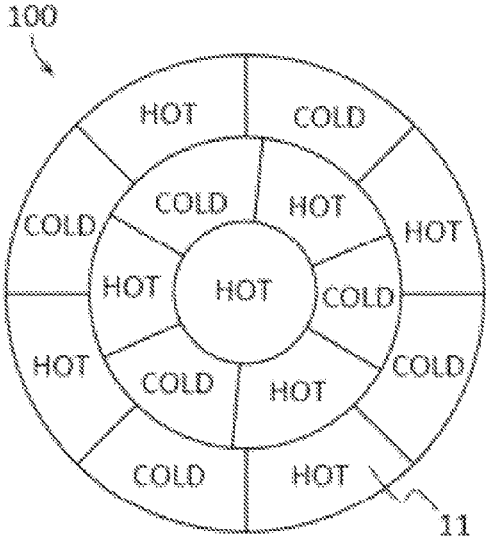
FIG. 4A, FIG. 4B, FIG. 4C, and FIG. 4D depict a top down view of various examples of possible food serving container temperature configurations of a temperature regulating food conveying container system comprising fifteen food serving containers according to various embodiments described herein.
Figure 4B:
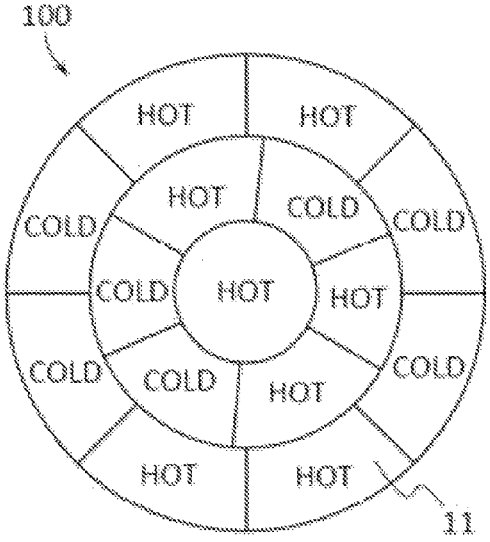
Figure 4C:
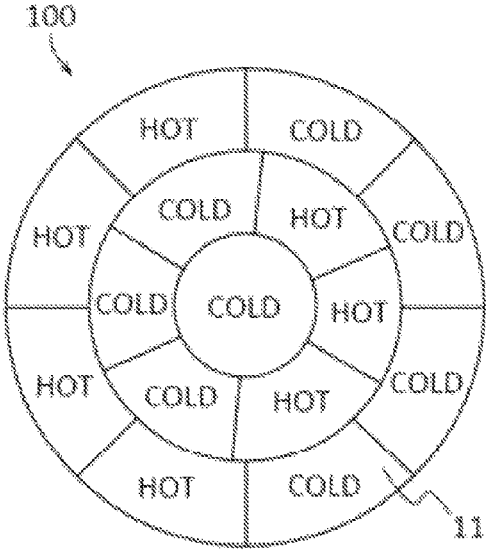
Figure 4D:
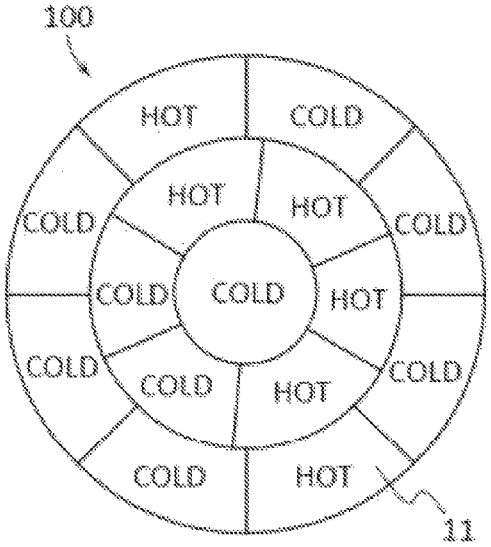

In preferred embodiments, a food serving container 11 is supported on an upper surface 13 in thermal contact with a temperature modifying unit 40. Each temperature modifying unit 40 is configured to make thermal contact with the container bottom 22 of at least one food serving container 11 in a one-to-one configuration whereby a single temperature modifying unit 40 is thermal contact with only one food serving container 11. In further embodiments, two or more temperature modifying units 40 may be in thermal contact with a single food serving container 11. In further preferred embodiments, FIG. 3 shows a perspective exploded view of an example of a temperature modifying unit 40 according to various embodiments described herein. Each food serving container 11 is in thermal contact with a temperature modifying unit 40 that is capable of maintaining a wide range of hot and cold temperatures. In preferred embodiments, the temperature unit 40 may comprise a thermo electric heating and cooling element such as a Peltier chip as illustrated in FIG. 3 and may optionally comprise a metal heat sink, and a fan which may relieve excess heat through one or more vents 44 (FIG. 1). A peltier chip temperature modifying unit 40 may be configured to control the temperature of the food serving container 11 placed in thermal connection with the temperature regulating surface 41 of the temperature modifying unit 40 thereby regulating the temperature within the container cavity 21 (FIG. 6) of the food serving container 11. In further preferred embodiments, the system 100 may comprise a first temperature modifying unit 40 which contains a first peltier chip positioned on a rotatable level 12 with the first temperature modifying unit 40 heating a first food serving container 11 to a hot temperature type in thermal contact with the first temperature modifying unit 40, and the system 100 may comprise a second temperature modifying unit 40 positioned directly proximate on the level 12 to the first temperature modifying unit 40 and the second temperature modifying unit 40 contains a second peltier chip cooling a second food serving container 11 to a cold temperature type which is in thermal contact with the second temperature modifying unit 40.

A Peltier chip uses the Peltier effect to create a heat flux between the junction of two different types of materials. A Peltier cooler, heater, or thermoelectric heat pump is a solid-state active heat pump which transfers heat from one side of the chip to the other, with consumption of electrical energy, depending on the direction of the current. Such an instrument is also called a Peltier device, Peltier heat pump, solid state refrigerator, or thermoelectric cooler (TEC). It can be used either for heating or for cooling, although in practice the main application is cooling. It can also be used as a temperature controller that either heats or cools. In other embodiments, a temperature modifying unit 40 may comprise various cooling means common in the art such as micro-refrigeration coils, freezer cool packs, chemical cool packs, cold stone panels, water ice, and dry ice may be used to cool the temperature of desired food serving containers 11. In further embodiments, a temperature modifying unit 40 may comprise various heating means common in the art such as electric heating elements, hot stone panels, and chemical heat packs may be used to heat the temperature of desired food serving containers 11.

A peltier chip temperature modifying unit 40 may comprise a first electrical junction 42 in electrical communication with a control switch 24 and a second electrical junction 42 in electrical communication with an electrical control switch 24. A plurality of two different semi-conductors 43, one n-type and one p-type, are placed thermally in parallel to each other and electrically in series with a plurality of conductors 45 and then joined with a temperature regulating surface 41 or thermally conducting plate on each side. When a voltage is applied to the electrical junctions 42 and to the free ends of the plurality of semiconductors 43 there is a flow of DC current across the junction of the semi-conductors 43 causing a temperature difference. The side with the cooling temperature regulating surface 41 absorbs heat which is then moved to the other temperature regulating surface 41 of the peltier chip which becomes hot resulting in a first temperature regulating surface 41 comprising a first temperature type and a second temperature regulating surface 41 comprising a second temperature type.

Once a control switch 24 in activated, electric current may be supplied to a temperature modifying unit 40 which is configured to produce thermoelectric heating and cooling effects on a first temperature regulating surface 41 and a second temperature regulating surface 41. A temperature modifying unit 40 may produce a first temperature type such as a hot temperature type on a first temperature regulating surface 41 and a second temperature type such as a cold temperature type on a second temperature regulating surface 41. The temperature type of a temperature regulating surface 41 is dependent upon the direction of electrical current supplied to the temperature modifying unit 40 preferably with a control switch 24 configured to send electrical DC current in a first direction to produce a first temperature type on a temperature regulating surface 41. The control switch 24 may also be configured to send electrical DC current in a second direction to produce a different temperature type such as a cold temperature type on a first temperature regulating surface 41 and a second temperature type such as a hot temperature type on a second temperature regulating surface 41.

In alternative embodiments a control unit 53 (FIGS. 7 and 8) may be used to control the amount or direction of electric power supplied to a temperature modifying unit 40 thereby controlling the thermoelectric heating and cooling effects on a first temperature regulating surface 41 and a second temperature regulating surface 41 of the temperature modifying unit 40. A temperature modifying unit 40 may produce a first temperature type such as a hot temperature type on a first temperature regulating surface 41 and a second temperature type such as a cold temperature type on a second temperature regulating surface 41. The temperature type of a temperature regulating surface 41 is dependent upon the direction of electrical current supplied to the temperature modifying unit 40 optionally with a control unit 53 configured to send electrical DC current in a first direction to produce a first temperature type on a temperature regulating surface 41. The control unit 53 may also be configured to send electrical DC current in a second direction to produce a different temperature type such as a cold temperature type on a first temperature regulating surface 41 and a second temperature type such as a hot temperature type on a second temperature regulating surface 41.

As perhaps best illustrated by FIG. 4, the food serving containers 11 may be configured to be either a substantially hot temperature type or a substantially cold temperature type and even with adjacent food serving containers being configured with substantially different temperature types. FIGS. 4A-D are for illustrative purposes only, and one skilled in the art will immediately recognize that any food serving container 11 may be maintained at a range of temperatures irrespective of its position on the temperature regulating food conveying container system 100 (FIGS. 1 and 2).

Figure 5:
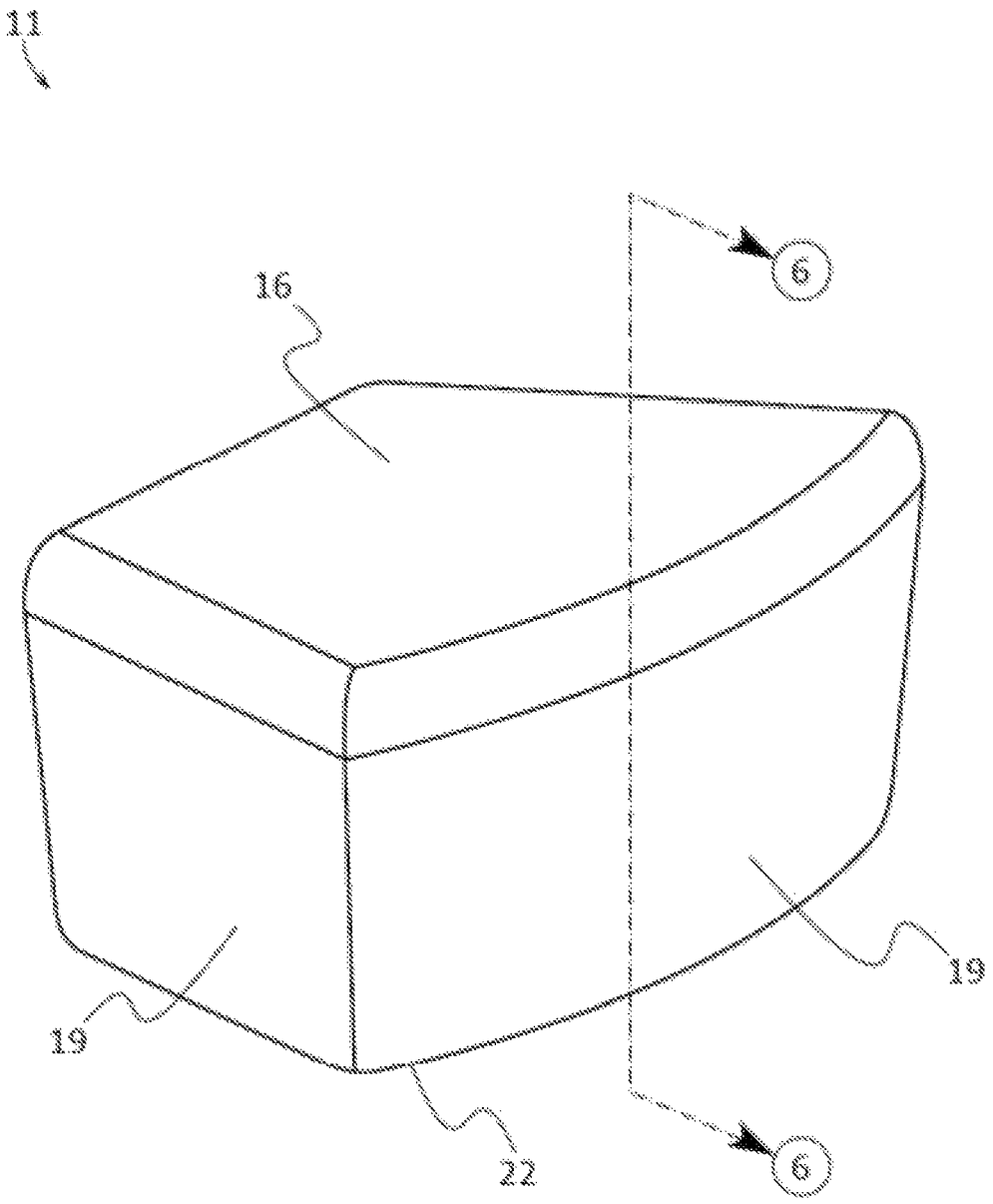
FIG. 5 illustrates a perspective view of an example of a food serving container according to various embodiments described herein.
Figure 6:
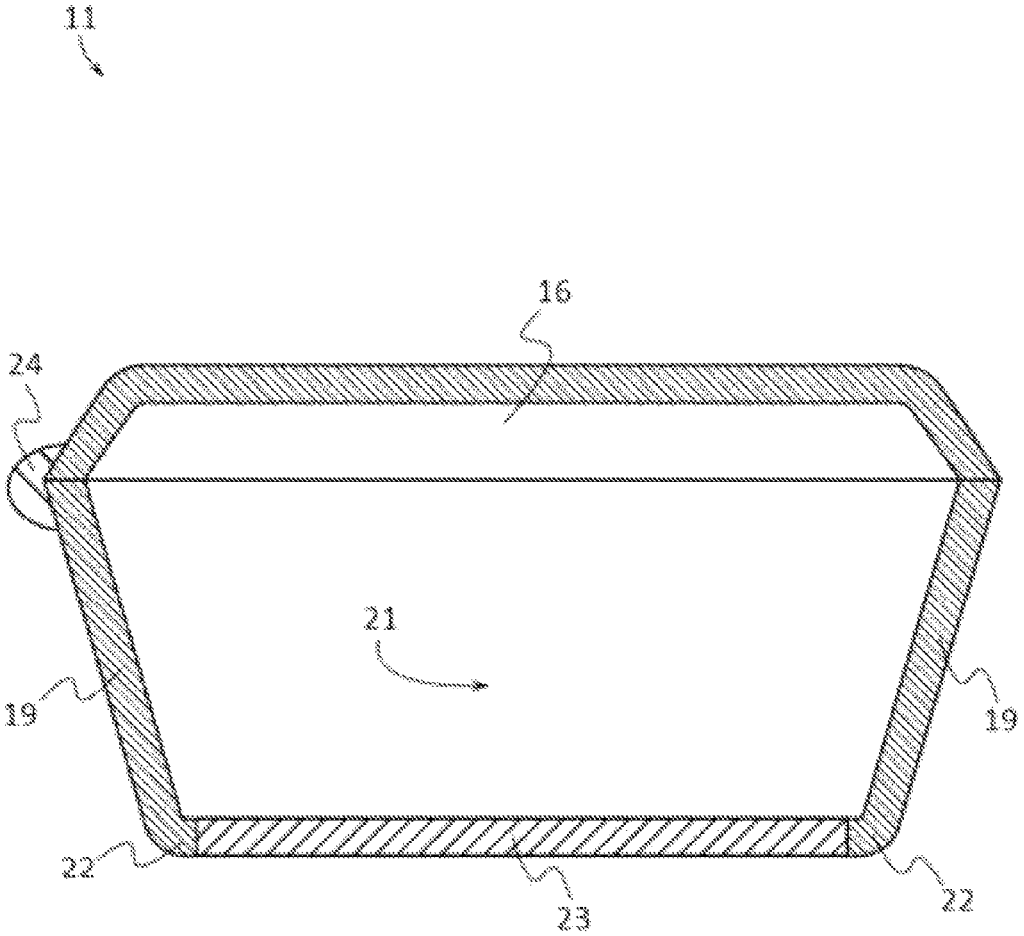
FIG. 6 shows a sectional, through line 6-6 shown in FIG. 5, elevation view of an example of a food serving container according to various embodiments described herein.

FIG. 5 illustrates a perspective view of an example of a food serving container 11, while FIG. 6 shows a sectional, through line 6-6 shown in FIG. 5, elevation view of an example of a food serving container 11 according to various embodiments described herein. In preferred embodiments, each food serving container 11 may comprise a lid 16 that pops or springs up without having to lift the lid 16, and may be activated by simply pushing downwardly on the lid 16 for a short distance to activate a lid lifting mechanism 25 or spring loaded hinge which moves the lid 16 into a raised, tilted position. The lids 16 may be closed by pushing the lid 16 downwardly toward the closed position so that the lid lifting mechanism 25 is retracted. In other embodiments, one or more of the lids 16 may be manually positioned on or off of one or more food containers 11. In some embodiments, the top most or upper level lid 16 may be of various shapes and configurations including flat shaped or dome shaped lids 16 to accommodate various types of food such as a whole chicken or other large item.

In preferred embodiments, a food serving container 11 may comprise a generally rectangular prism shape with four container side walls 19 substantially permanently coupled to each other and to a container bottom 22 with a lid 16 temporarily coupled to the four container side walls 19 opposite the container bottom 22, thereby forming a container cavity 21. A container bottom 22 may further comprise a thermally conductive bottom surface 23 made from a thermally conductive material such as aluminum, copper, other metal or metal alloy, thermally conductive ceramics, thermally conductive plastics, thermally conductive, glass, and the like. Portions of the container bottom 22 and/or thermally conductive bottom surface 23 may contact a temperature regulating surface 41 of a temperature modifying unit 40 of a level 12 allowing the temperature modifying unit 40 to regulate the temperature within the container cavity 21.

It should be understood to one of ordinary skill in the art that the food serving containers 11 may be configured in a plurality of sizes and shapes including spherical shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes may be made without departing from the spirit or scope of the invention.

In the embodiments depicted in FIGS. 1 and 4), a lower level 12A is shown with eight food serving containers 11, a second level 12B is shown with six food serving containers 11, and an upper level 12C is shown with one food serving container 11 with each food container 11 in thermal communication with at least one temperature unit 40 (FIGS. 2 and 3). Thermal communication may optionally be achieved by a thermally conductive material that comprises the thermally conductive bottom surface 23 that separates the container bottom 22 of a food serving container 11 (FIGS. 1, 2, 5, and 6) supported on the upper surface of each level from the one or more temperature units 40 (FIG. 2) located on the lower surface 13 of each level 12. In some embodiments, the thermal communication may be achieved by one or more aluminum plates that are positioned on the lower level 12A, second level 12B, and upper level 12C (FIGS. 1 and 2). Each plate may support one or more food containers 11 on its upper surface 13 and one or more temperature elements 40 (FIG. 2) on its lower surface. The thermally conductive material may be made from plastics, metal alloys, ceramic, glass, and the like.

One skilled in the art will also immediately recognize that as the temperature regulating food conveying container system 100 (FIGS. 1, 2, and 4) is made in larger dimensions, greater quantities and sizes of food serving containers 11 (FIGS. 1, 2, 4-6) in thermal communication with at least one temperature modifying unit 40 (FIGS. 2 and 3) may be utilized. Also as the temperature regulating food conveying container system 100 is made in smaller dimensions, lesser quantities and sizes of food containers 11 in thermal communication with at least one temperature modifying unit 40 may be utilized. In some embodiments, between one and 20 food serving containers 11 may be positioned on each of the lower level 12A, one or more second levels 12B, and upper levels 12C.

Figure 7:
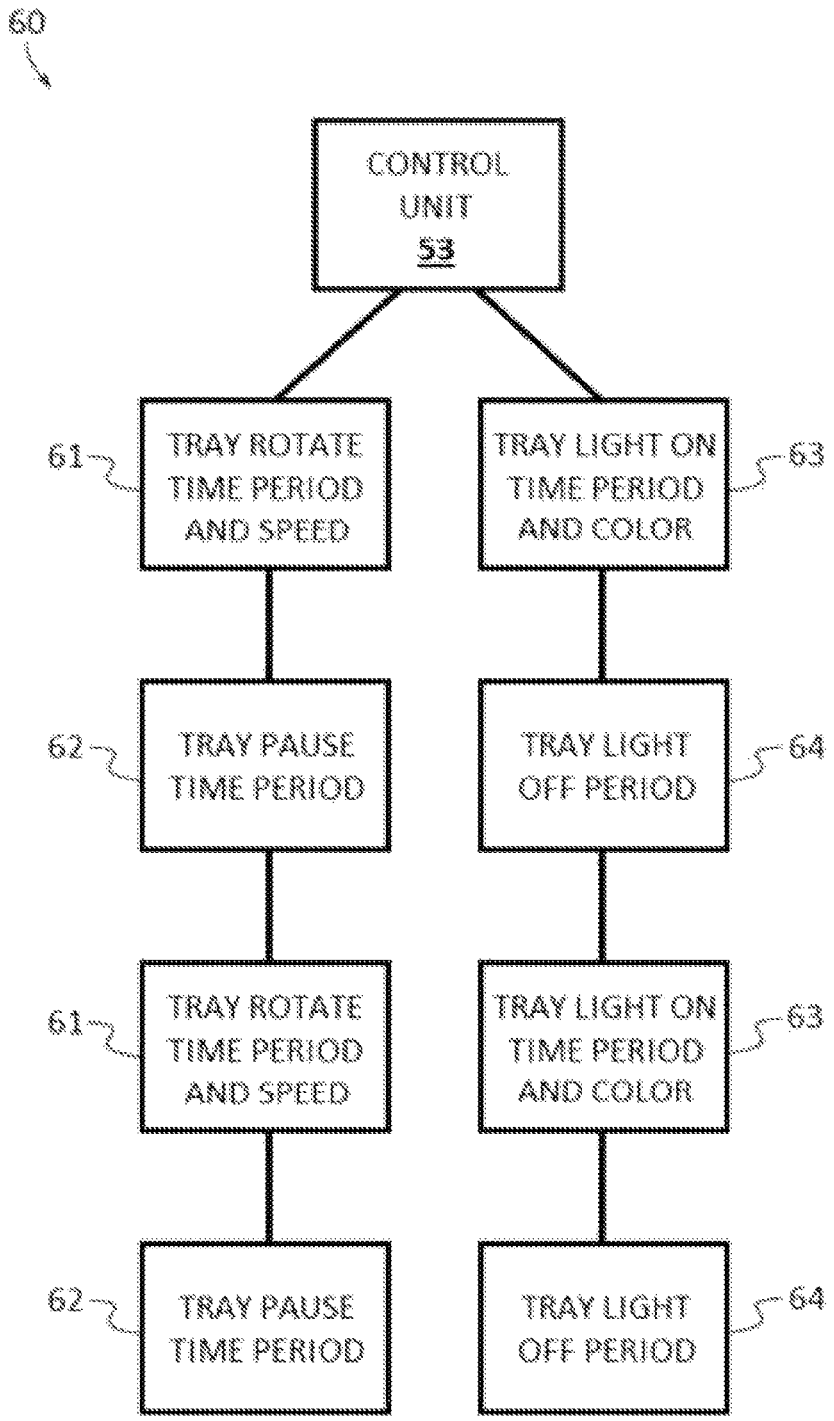
FIG. 7 depicts an example of control unit program configured to intermittently activate level rotation and illumination according to various embodiments described herein.

Referring now to FIG. 7, the temperature regulating food conveying container system 100 (FIGS. 1 and 2) may comprise a control unit 53 that may be configured to intermittently activate one or more light elements 30 and/or motors 20 according to the exemplary program flow chart 60 depicted. In preferred embodiments, the light elements 30 (FIG. 2) and motors 20 (FIG. 2) associated with each level 12 may be individually controlled, and they may be controlled in unison so that the light elements 30 (FIG. 2) may change color or intensity when the levels 12 are rotating or when the levels 12 are not rotating. In further preferred embodiments, the control unit 53 may be configured to rotate one or more individual levels 12 only during intermittent time periods, with a pause 62 in the rotation between the periods of rotation in addition to being configured to control the rotation speed 61 of each level 12. In other embodiments, the control unit 53 may be configured to cause one or more light elements 30 (FIG. 2) to display different colors and intensities of light 63, including displaying no light 64, for various patterns of time, or even in response to ambient sounds such as music. In further embodiments, light elements 30 (FIG. 2) may be configured to indicate the temperature of an adjacent food container 11 (FIGS. 1 and 2) such that, for example, hot temperature type food containers 11 (FIGS. 1 and 2) may be illuminated with red light from an adjacent light element 30 (FIG. 2) while cold temperature type food containers 11 (FIGS. 1 and 2) may be illuminated with blue light from an adjacent light element 30 (FIG. 2). Other colors of light and temperature combinations may be used.

Figure 8:
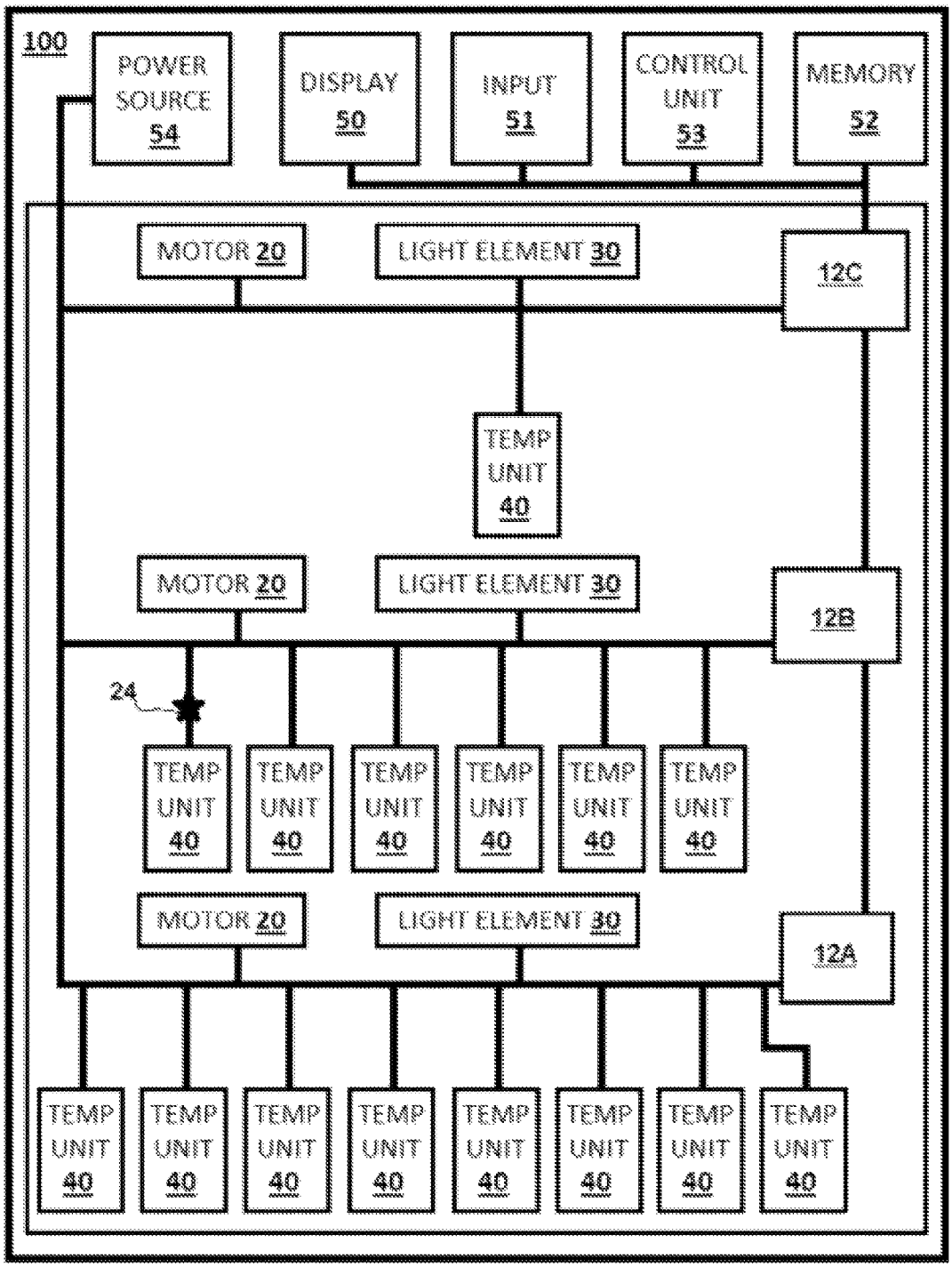
FIG. 8 illustrates an alternative example of a control diagram of a temperature regulating food conveying container system according to various embodiments described herein.

An alternative example of a control diagram of a temperature regulating food conveying container system 100 (FIGS. 1 and 2) is illustrated in FIG. 8. In this example, the control unit 53 is configured with a memory 52 that is capable of storing and executing program instructions to the control unit 53. A user may manipulate the controls on an input 51 to manipulate the light, rotation, and temperature settings which may be indicated on a display 50. A user may manipulate the input 51 and the control unit 53 may direct the amount and direction of electric current supplied to a temperature modifying unit (temp units) 40 to manipulate temperature type of a temperature modifying units 40 and the food serving container 11 it is in thermal contact with. The input 51 may comprise knobs, buttons, switches, touch screens and the like. Once the settings are selected, they may be stored as a program in the memory 52 and used to by the control unit 53 to control one or more motors 20, light elements 30, and temperature units 40. Electrical power is supplied by a power source 54 which may supply direct current (DC) or alternating current (AC). The power source 54 may use batteries or be plugged into an electrical outlet with an optional electrical cord and plug. In preferred embodiments, each temperature modifying unit 40 may be in electronic communication with a control switch 24 configured to turn on or off the temperature modifying unit 40 or adjust the current to modify the temperature output from hot to cold. As shown by this example in FIG. 8, the temperature modifying units 40 is in electrical communication with a switch 24 and optionally a central control unit 53. The solid black lines in FIG. 8 represent a possible electrical connection between the elements shown. Electrical connections are used to facilitate electrical communication and may comprise wiring, printed circuits, wiping electrical contacts 18, or other suitable electrical connections as is common in the art.

Figure 9:
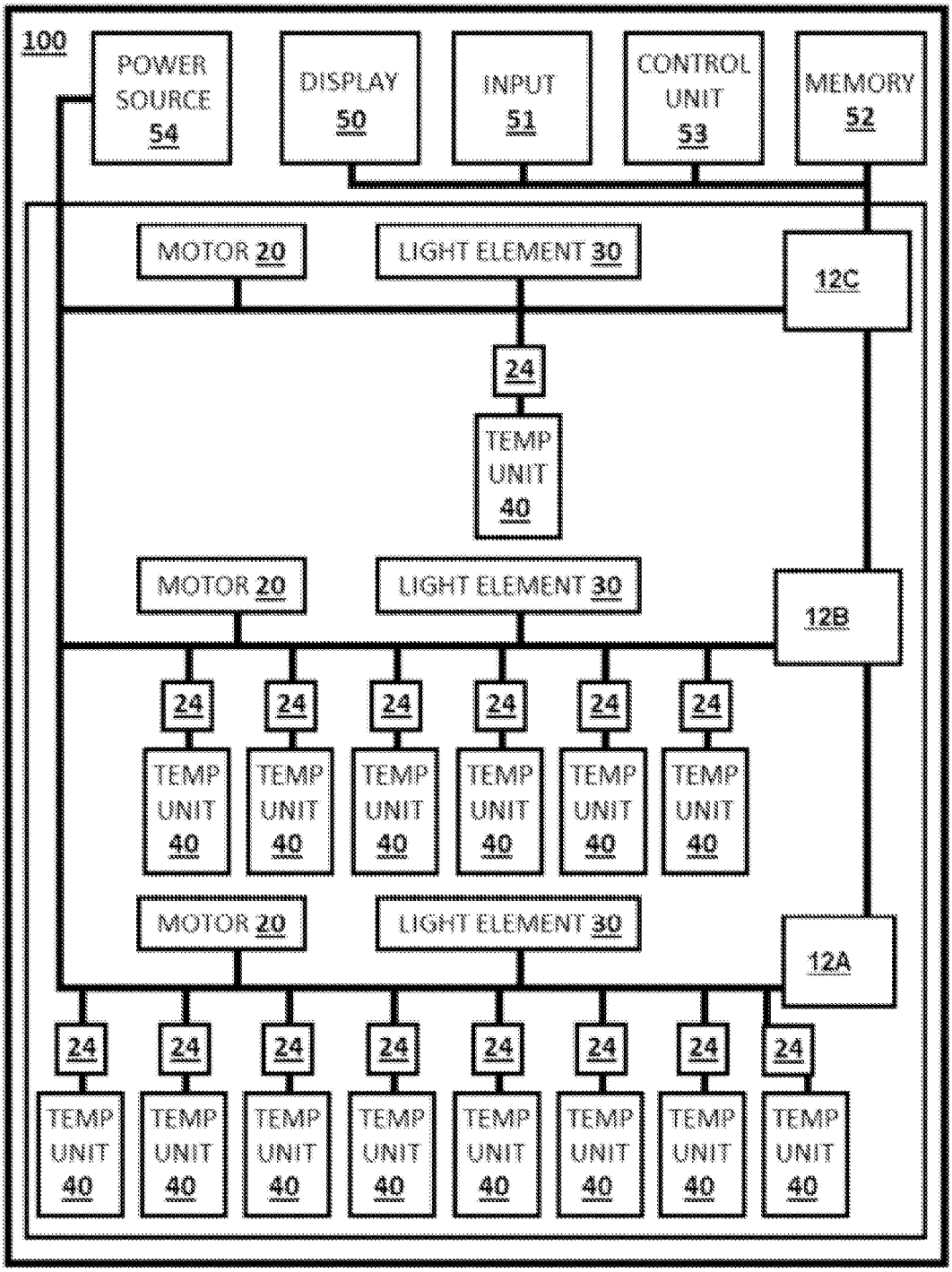
FIG. 9 shows a preferred example of a control diagram of a temperature regulating food conveying container system according to various embodiments described herein.

A preferred example of a control diagram of a temperature regulating food conveying container system 100 (FIGS. 1 and 2) is illustrated in FIG. 9. In this example, the control unit 53 is configured with a memory 52 that is capable of storing and executing program instructions to the control unit 53. A user may manipulate the controls on an input 51 to manipulate the light and temperature settings which may be indicated on a display 50. The input 51 may comprise knobs, buttons, switches, touch screens and the like. Once the settings are selected, they may be stored as a program in the memory 52 and used to by the control unit 53 to control one or more motors 20 and light elements 30. A user may manipulate the control switch 24 of a temperature modifying unit (temp units) 40 to manipulate the amount and direction of electric current supplied to a temp unit 40 thereby manipulating the temperature type of the temp unit 40 and the food serving container 11 it is in thermal contact with. Electrical power is supplied by a power source 54 which may supply direct current (DC) or alternating current (AC). The power source 54 may use batteries or be plugged into an electrical outlet with an optional electrical cord and plug. In preferred embodiments, each temperature modifying unit 40 may be in electronic communication with a control switch 24 configured to turn on or off the temperature modifying unit 40 or adjust the current to modify the temperature output from hot to cold. As shown by this example in FIG. 9, the temperature modifying units 40 is in electrical communication with a switch 24 and optionally a central control unit 53. The solid black lines in FIG. 9 represent a possible electrical connection between the elements shown. Electrical connections are used to facilitate electrical communication and may comprise wiring, printed circuits, wiping electrical contacts 18, or other suitable electrical connections as is common in the art.

Figure 10:
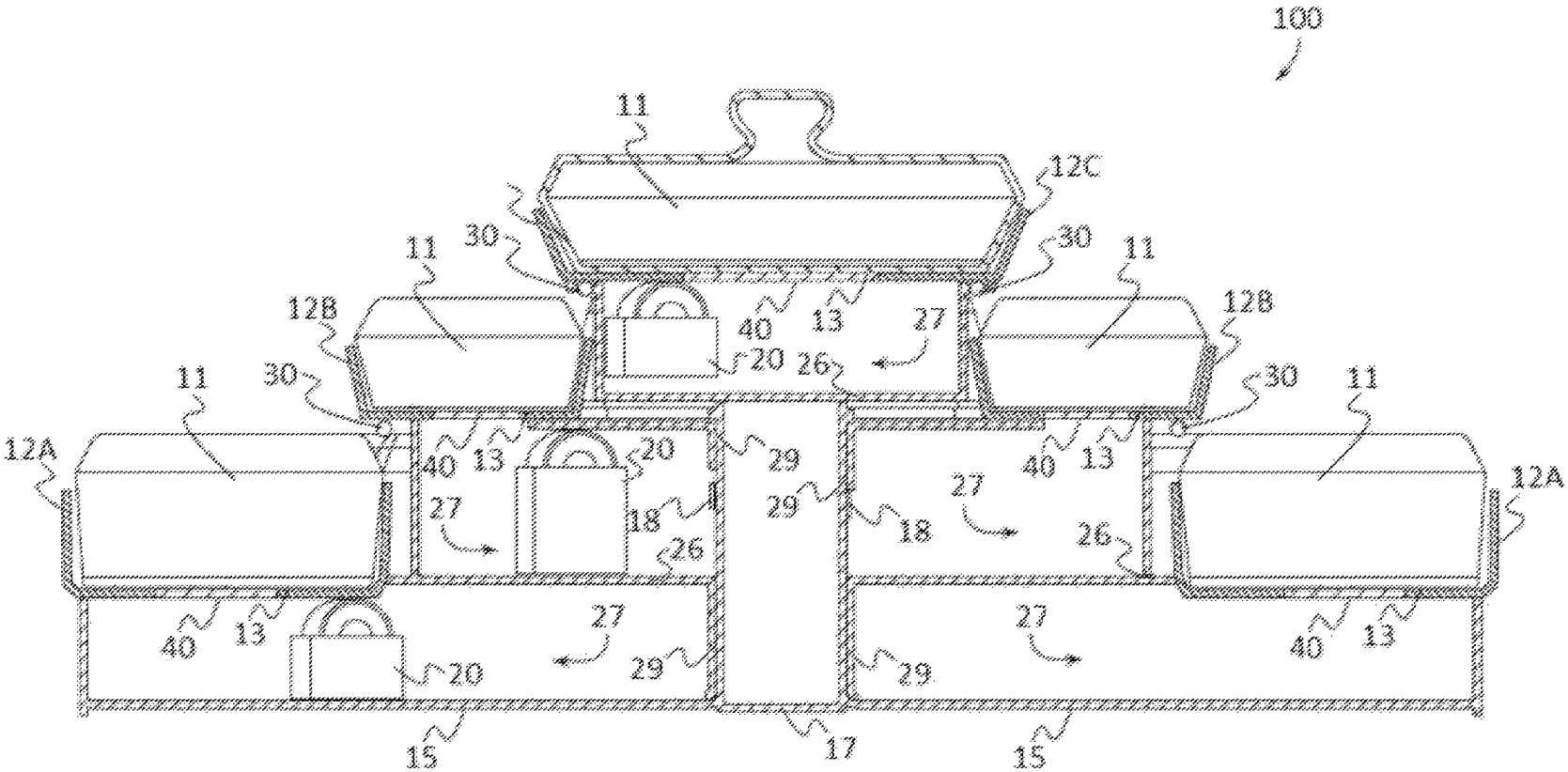
FIG. 10 depicts a sectional, through line 2-2 shown in FIG. 1, elevation view of an alternative example of a temperature regulating food conveying container system according to various embodiments described herein.

FIG. 10 depicts a sectional, through line 2-2 shown in FIG. 1, elevation view of an alternative example of a temperature regulating food conveying container system 100 according to various embodiments described herein. In this alternative embodiment, the first or lower level 12A, second or second level 12B, and third or upper level 12C are optionally each equipped with one or more motors 20 configured the rotate the individual levels 12 around a central support 17 which is attached to the base 15 in a substantially perpendicular orientation. The lower level 12A, second level 12B, and upper level 12C are each coupled to one or more level side walls 26 optionally forming a level chamber 27 below each level 12. A level chamber 27 may form a hollow space allowing one or more electrical components such as temperature modifying units 40, motors 20, control units 53 (FIGS. 7-9) to be received within the system 100 and coupled to a level side wall 26. One or more level side walls 26 may also be rotatably coupled to the central support 17 and/or the base 15 with one or more rotational couplings 29 allowing the lower level 12A, second level 12B, and upper level 12C to rotate independently around the axis provided by the central support 17 which may be non-rotatably coupled to the base 15.

A rotational coupling 29 may comprise a bearing such as a plain bearing, rolling elements bearing, jewel bearing, fluid bearing, magnetic bearing, or any other suitable connection method suitable for coupling a level side wall 26 to a central support 17 while allowing the level side wall 26 to rotate relative to a central support 17. Wiping electrical contacts 18 optionally coupled to the central support 17 may provide uninterrupted electrical power to the electrical components such as motors 20, thermal modifying units 40, and light elements 30 of a level 12 as each level rotates independently around the axis provided by the central support 17.

The motors 20 may be configured with gears, chains, screw drives, belts, or any other suitable rotational enabling method which may be attached to each level 12 thereby transferring the rotational motion of one or more motors 20 into rotational movement for the lower level 12, second level 12B, and upper level 12C. In some embodiments, a motor 20 may be coupled to a level side wall 26 and be configured to rotate one or more gears comprising a plurality of teeth. The teeth of the gears may be configured to engage with a component of a level 12 such as a plurality of protrusions on a surface of the level 12, thereby transferring the rotational movement from the motor 20 coupled to the level side wall 26 to rotate the level 12. In other embodiments, a motor 20 may be coupled to a surface of a level 12 and be configured to rotate one or more gears comprising a plurality of teeth. The teeth of the gears may be configured to engage with a component of a level side wall 26 such as a plurality of protrusions on a surface of the level side wall 26, thereby transferring the rotational movement from the motor 20 coupled to the level 12 to rotate the level 12. In preferred embodiments, the motors 20 are capable of rotating the individual levels 12 at a range of speeds while the base 15 remains stationary. In some embodiments, the upper level 12C may not be configured to rotate and may instead be stationary in nature.

The lower level 12A, middle level 12B, upper level 12C, base 15, lids 16, and food containers 11 may be made from various plastics including polycarbonate, metal alloys, wood, ceramics or other suitable materials. One or more of the elements described herein may be coupled be being connected, removably connected, or integrally formed or molded with the system 100. In some embodiments, one or more elements may be made from injected molded nylon, glass filled nylon, other plastics, metal alloys, carbon fiber, or other similar materials, and they may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more elements may be coupled or removably connected by being press fit or snap fit together, by one or more fasteners such as magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary connection method as one reasonably skilled in the art could envision to serve the same function. In further embodiments, one or more elements described herein may be coupled by being one of connected to and integrally formed with another element of the system 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A temperature regulating food conveying container system for heating and cooling a plurality of food serving containers, the temperature regulating food conveying container system comprising:

a. a base for resting on a surface and configured to support a plurality of levels;

b. a lower level mounted to and above the base and a second level vertically adjacent to and above the lower level, the lower level and the second level supporting a plurality of food serving containers;

c. the plurality of food serving containers each comprising container side walls adapted to retain food within a container cavity, and a container bottom with said container bottom having a thermally conductive bottom surface;

d. a plurality of discrete temperature modifying units mounted to at least one of the lower level and the second level, and each discrete temperature modifying unit of the plurality of the discrete temperature modifying units comprising a temperature regulating surface configured to be in thermal connection with the container bottom;

e. a control switch in electrical communication with at least one discrete temperature modifying unit of the plurality of discrete temperature modifying units, said control switch configured to change the temperature regulating surface of the discrete temperature modifying unit of the plurality of discrete temperature modifying units between a first temperature type and a second temperature type; and wherein at least one of the lower level and the second level is configured to rotate around a central support, said central support and said at least one of the lower level and the second level comprising electrical wiping contacts in communication with each other and configured to provide an electrical connection to the plurality of discrete temperature modifying units.

2. The system of claim 1, wherein the lower level and second level are circular and are configured to rotate around said central support with said central support coupled to the base.

3. The system of claim 2, further comprising an upper third level vertically adjacent to and above the second level, the upper third level having an upper surface said upper third level houses a discrete temperature modifying unit of the plurality of discrete temperature modifying units with the discrete temperature modifying unit housed in the upper third level configured to make thermal contact with a container bottom of a food serving container of the plurality of food serving containers.

4. The system of claim 1, wherein the bottom surface of each of the plurality of food serving containers are thermally conductive, said bottom surface is selected from a material comprising at least one of aluminum and copper.

5. The system of claim 1, wherein the first temperature type is hot and the temperature regulating surface is heated by a thermoelectric effect by an electrical current sent to the temperature modifying unit and the second temperature type is cold and the temperature regulating surface is cooled by a thermoelectric effect by an electrical current sent to the temperature modifying unit.

6. The system of claim 5, wherein the first temperature type is between 100 to 300 degrees Fahrenheit and the second temperature type is between 20 to 70 degrees Fahrenheit.

7. The system of claim 1, wherein the first temperature type and the second temperature type are dependent upon a direction of electrical current supplied to the temperature modifying unit and the control switch is configured to send electrical current in a first direction to produce the first temperature type and the control switch is configured to send electrical current in a second direction to produce the second temperature type.

8. The system of claim 7, wherein the electrical current is Direct Current (DC).

9. The system of claim 1, wherein the temperature modifying unit contains a first electrical junction in electrical communication with the control switch and a second electrical junction in electrical communication with the control switch, and a semiconductor positioned between said first and said second electrical junctions.

10. The system of claim 9, wherein the temperature modifying unit is a thermoelectric heating and cooling element.

11. The system of claim 10, wherein the temperature modifying unit is a peltier chip.

12. The system of claim 1, wherein:

a. a first temperature modifying unit consisting of a first peltier chip is positioned on an upper surface of the lower level with said first peltier chip in thermal contact with a first container thermally conductive bottom surface; and b. a second temperature modifying unit positioned directly proximate to said first temperature modifying unit on the upper surface of the lower level with said second temperature modifying unit consisting of a second peltier chip in thermal contact with a second container thermally conductive bottom surface.

13. The system of claim 12, wherein the first temperature modifying unit is configured to generate heat above 70 degrees Fahrenheit and the second temperature modifying unit has a temperature regulating surface with a surface temperature below 70 degrees Fahrenheit.

14. The system of claim 1, wherein the second level comprises a plurality of lighting elements.

15. The system of claim 14, wherein the plurality of lighting elements comprise light emitting diodes (LEDs).

16. The system of claim 1, wherein each food serving container of the plurality of food service containers comprises a lid with a lid lifting mechanism.

17. The system of claim 16, wherein the lid lifting mechanism comprises a spring loaded hinge.

18. The system of claim 1, further comprising an electrical motor positioned within the base and in mechanical connection with the lower level.

* * * * *